US008668194B2

(12) United States Patent
Peters et al.

(10) Patent No.: US 8,668,194 B2
(45) Date of Patent: Mar. 11, 2014

(54) MEDIA CASSETTE

(75) Inventors: Ken Peters, Dundee (GB); Derek Pont, Dundee (GB)

(73) Assignee: NCR Corporation, Duluth, GA (US)

( * ) Notice: Subject to any disclaimer, the term of this patent is extended or adjusted under 35 U.S.C. 154(b) by 206 days.

(21) Appl. No.: 13/194,255

(22) Filed: Jul. 29, 2011

(65) Prior Publication Data

US 2013/0026178 A1 Jan. 31, 2013

(51) Int. Cl.
*B65H 1/26* (2006.01)

(52) U.S. Cl.
USPC ..... 271/157; 271/160; 271/149

(58) Field of Classification Search
USPC ..... 271/145, 147, 149, 157, 160
See application file for complete search history.

(56) References Cited

U.S. PATENT DOCUMENTS

| | | | | |
|---|---|---|---|---|
| 4,978,416 | A * | 12/1990 | Potter et al. | 156/571 |
| 5,335,899 | A * | 8/1994 | Golicz | 271/34 |
| 6,592,118 | B2 * | 7/2003 | Youn | 271/147 |
| 7,497,436 | B2 * | 3/2009 | Tocher | 271/162 |
| 7,850,164 | B2 * | 12/2010 | Ahn et al. | 271/162 |
| 8,196,820 | B2 * | 6/2012 | Coventry et al. | 235/383 |

* cited by examiner

*Primary Examiner* — Patrick Mackey
(74) *Attorney, Agent, or Firm* — Paul W. Martin

(57) ABSTRACT

A media cassette is described. The media cassette comprising: a media removal window at one end of the media cassette; a handle end at an opposite end of the cassette to the media removal window; and a pusher plate assembly. The pusher plate assembly includes: (i) a finger recess component, (ii) a pawl biased downwards to a low position, and (iii) an actuator coupled to both the pawl and the finger recess component and including a pivot. The actuator is moveable on insertion of a finger into the finger recess component to raise the pawl from the low position to a high position.

20 Claims, 6 Drawing Sheets

FIG. 1
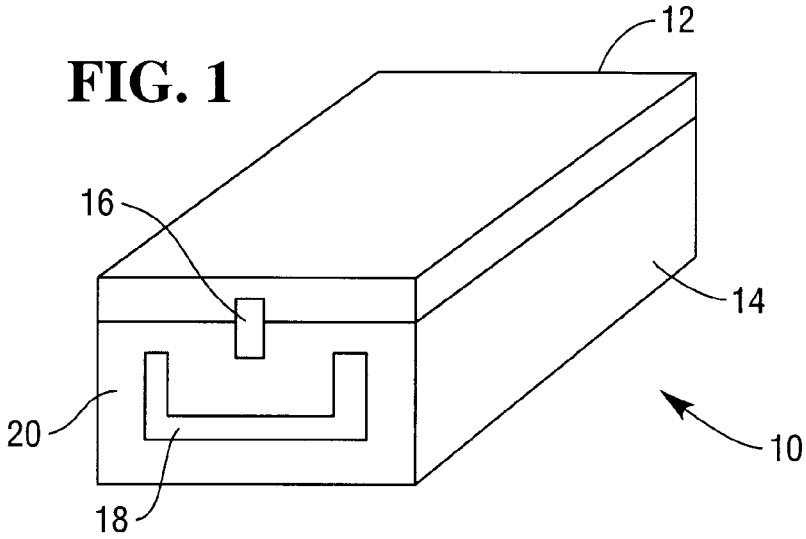
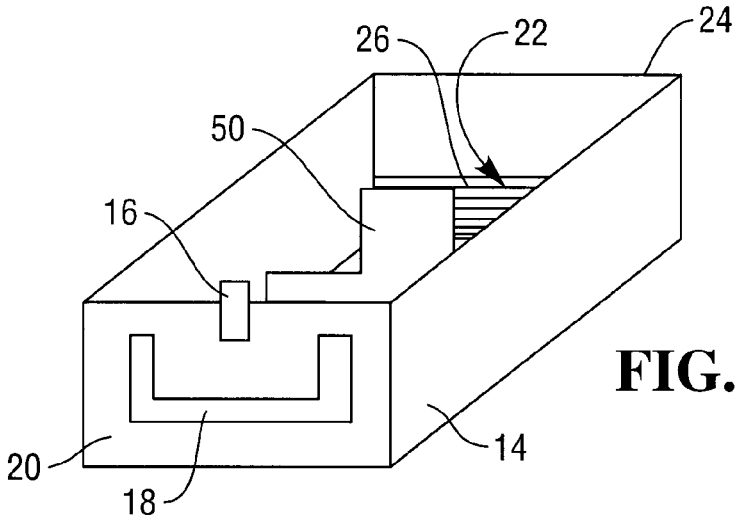
FIG. 2
FIG. 3
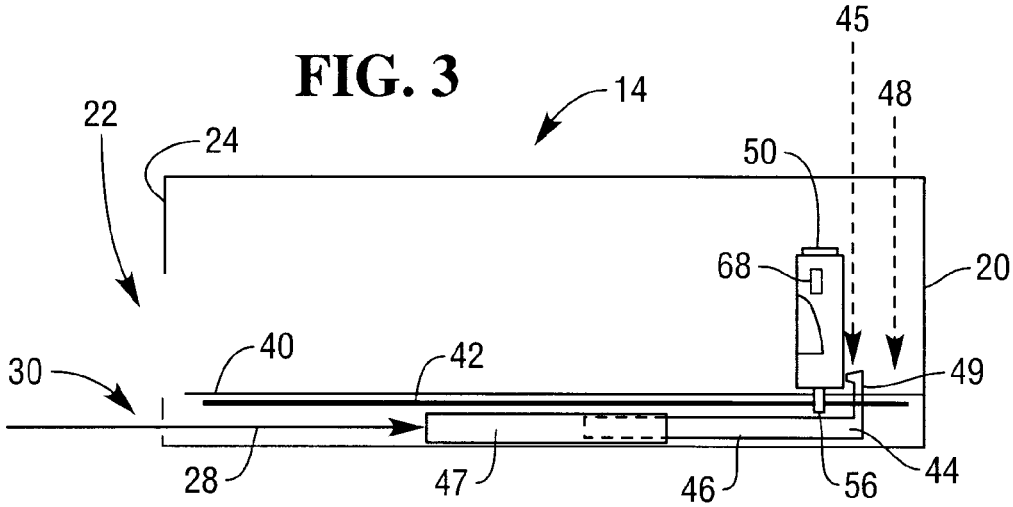

FIG. 4
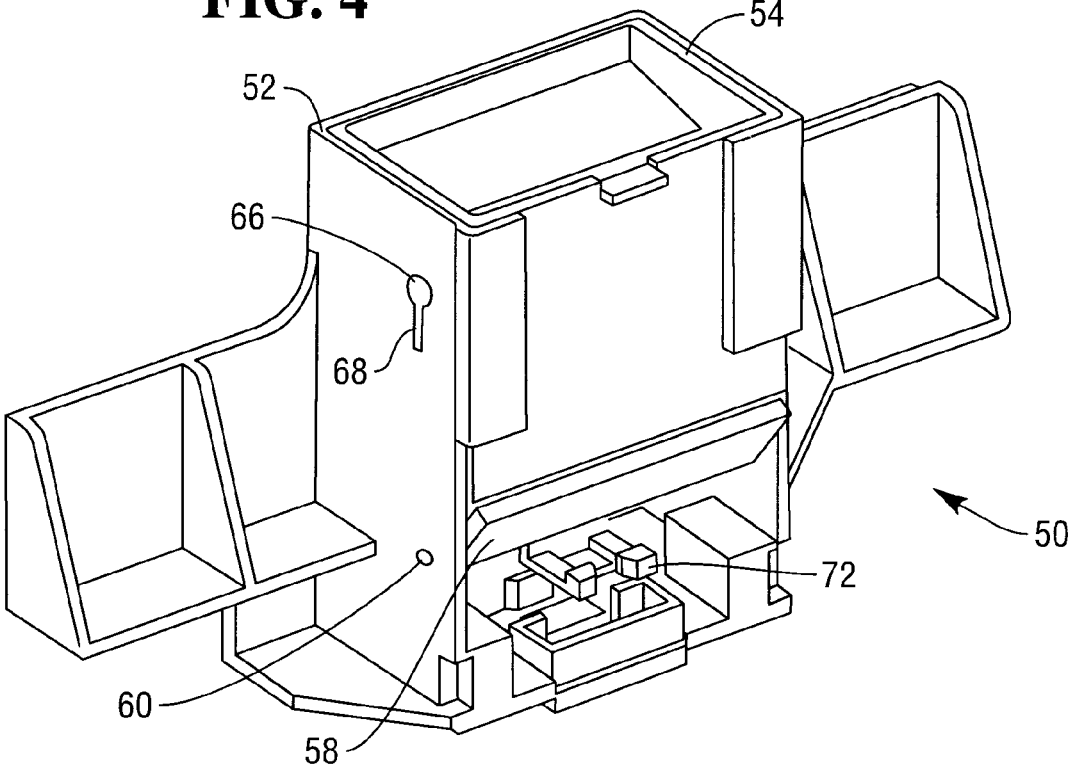
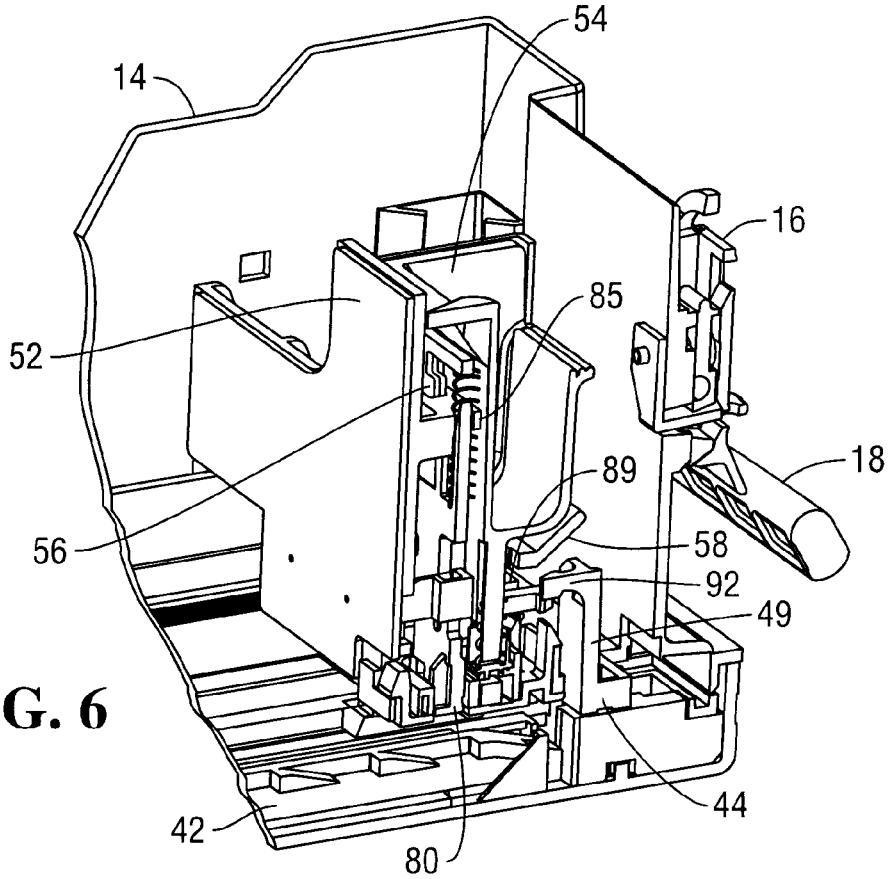
FIG. 6

MEDIA CASSETTE

FIELD OF INVENTION

The present invention relates to improvements in, or relating to, a media cassette.

BACKGROUND OF INVENTION

Media cassettes are used in self-service terminals (SSTs), such as automated teller machines (ATMs). ATMs use media cassettes for a variety of different types of media. However, the most common use of an ATM media cassette is for storing currency (in the form of banknotes) in a manner that allows the currency to be removed, one banknote at a time, from the media cassette (referred to as a currency cassette). The currency is typically stored as a horizontal stack within the currency cassette.

To enable the stored banknotes to be removed reliably, the currency cassette includes a pusher plate that urges the horizontal stack towards a picking area.

When the currency cassette is empty (or nearly empty), it can be manually replenished by removing the lid, retracting the pusher plate, and inserting a new horizontal stack of banknotes between the picking area and the pusher plate. In some currency cassettes, the pusher plate must first be lifted so that it disengages from a ratchet rack near the base of the currency cassette prior to being retracted. This is awkward for a replenisher because a force must be applied downwards on the currency cassette, upwards on the pusher plate, and backwards on the pusher plate, all at the same time.

Another problem associated with replenishing some currency cassettes is that there is a risk that the pusher plate will be accidentally released by the replenisher while the replenisher's hand is between the picking area and the pusher plate. This could injure the replenisher's hand or at least cause some discomfort to the replenisher.

A further problem associated with currency cassettes is that a replenisher may insert too many banknotes (referred to as overstuffing). This can cause excessive force on the banknote nearest the picking area, which can result in failed picking (no banknote picked) or multiple picking (more than one banknote picked in a single picking operation). Neither of these is desirable.

Techniques for reducing the possibility of overstuffing are described in US patent application numbers 20100156034 and 20100156035, which involve using a detent to hold the pusher plate in place while the cassette is being loaded.

One problem associated with some currency cassettes that include an overstuffing detent is that if the replenisher only wants to partially fill the cassette, then the pusher plate may have to be disengaged from the overstuffing detent prior to closing the cassette lid. This again gives rise to the possibility that the replenisher's hand may be in the path of the pusher plate.

SUMMARY OF INVENTION

Accordingly, the invention generally provides methods, systems, and apparatus for an improved media cassette comprising a pusher plate defining a finger-engagement recess so that downward pressure on the recess disengages the pusher plate from a ratchet.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media cassette comprising:

a media removal window at one end of the media cassette;

a handle end at an opposite end of the cassette to the media removal window;

a pusher plate assembly including (i) a finger recess component, (ii) a pawl biased downwards to a low position, and (iii) an actuator coupled to both the pawl and the finger recess component and including a pivot, the actuator being moveable on insertion of a finger into the finger recess component to raise the pawl from the low position to a high position.

The media cassette may further comprise a ratchet rack operable to prevent movement of the pawl towards the handle end when the pawl is in the low position and to allow movement of the pawl towards the media removal window.

The media cassette may further comprise an urging member coupled to the pusher plate and operable to bias the pusher plate assembly towards the media removal window. The urging member may be in the form of a coil spring, a leaf spring, a gas spring, (each a "pusher plate spring") or any other convenient urging member.

The ratchet rack may include a profiled portion extending along a replenishment zone from the media removal window towards a loading position, where the profiled portion is operable to prevent movement of the pawl towards the handle end when the pawl is in the low position. The ratchet rack may also include an non-engagement portion extending along an expansion zone from the loading position to near the handle end to allow the pusher plate assembly to move towards the handle end when the pawl is located over the non-engagement portion, even when the pawl is in the low position. The non-engagement portion may define a channel through which the pawl moves. Alternatively, the ratchet rack may define a profiled portion extending along its entire length, but the ratchet rack may only extend from the media removal window to near (but short of) the loading position. This would ensure that when the pusher plate assembly is located at the loading position, the pawl would not engage with the ratchet rack.

Preferably, the finger recess component is dimensioned to receive a plurality of fingers (for example, two fingers of an adult human). Alternatively, the finger recess component may be dimensioned to accommodate only a single finger. Accommodating only a single finger may be less preferable because the pusher plate spring may be too stiff to be retracted easily by only one finger. Using multiple fingers may provide improved strength and control.

By providing a finger recess for a replenisher, the replenisher is provided with a more secure way of gripping the pusher plate assembly, so that it is less likely that the pusher plate assembly will slip out of the replenisher's grasp.

By enabling a downwards force to be used to lift the pawl, it is less likely that the replenisher's finger(s) will slip off the pusher plate assembly than if an upwards force was required.

The pawl may be slidably mounted in the pusher plate assembly. The pawl may slide vertically. Alternatively, the pawl may be pivotably mounted in the pusher plate assembly.

The pusher plate assembly may further comprise an engagement projection defining one or more formations complementary to formations defined by a loading position detent located near the handle end of the media cassette.

The engagement projection may be integral with the finger recess component and may extend therefrom towards the handle end of the media cassette.

The finger recess component may be slidably mounted in the pusher plate assembly and may depress one end (the front end) of the actuator when the finger recess component is pushed downwards. The finger recess component may be slidably mounted for vertical movement.

The actuator may comprise a bevelled cross-section and may include a rear end extending at an angle from the front end, and may define pivot shafts at the edges where the front end and rear end meet. The rear end may comprise a pair of flaps that engage with the pawl, so that as the front end is depressed, the actuator pivots, and the rear end rises, raising the pawl.

The engagement projection may align with, but be vertically offset from, the loading position detent when the finger recess component is depressed, and may align and engage with the loading position detent when the finger recess component is released.

The finger recess component may define a cut-away entrance to facilitate insertion of fingers therein.

The finger recess component may include a high friction grip adjacent to the cut-away entrance to reduce the possibility of an inserted finger slipping out of the finger recess component. The high friction grip may comprise elastomeric material, such as rubber.

The loading position detent may include a pair of legs (the detent legs), each leg being located on an opposite side of the ratchet rack, and extending parallel to the ratchet rack. The detent legs may be slideable relative to the ratchet rack.

The loading position detent may be held at a loading position by a retaining block. The retaining block may be displaced automatically on insertion of the media cassette into a media dispenser. When the retaining block is displaced, the pusher plate assembly may be operable to move the loading position detent towards an extended position, thereby increasing a storage space for media items within the media cassette and reducing problems associated with overstuffing of media items.

When the loading position detent moves towards the extended position, the pusher plate assembly can move over the unprofiled portion of the ratchet rack, which allows movement of the pawl over the expansion zone.

The loading position detent may include a barbed stub extending towards the pusher plate assembly and defining a mutually complementary formation to the engagement projection to provide a snap fit when the engagement projection is brought into contact with the protrusion.

The media cassette may comprise a body and a removable lid coupled thereto. The media cassette may comprise an automatic pusher plate release mechanism. The automatic pusher plate release mechanism may be operated by closure of the lid.

The lid may define a raised boss on an underside of the lid, and at a location corresponding to the loading position when the lid is coupled to the body. The raised boss may be aligned with a pad area on the finger recess component, so that closure of the lid exerts downwards pressure on the finger recess component if the pusher plate assembly is located at the loading position. Exerting downwards pressure on the finger recess component may raise the pawl from the low position to the high position, thereby releasing the pusher plate assembly from the loading position.

The media cassette may be a currency cassette for storing banknotes.

According to a second aspect there is provided a media dispenser comprising: a pick unit including a pair of tines for engaging with a media cassette; and a media cassette according to the first aspect mounted in the pick unit.

According to a third aspect there is provided a self-service terminal including the media dispenser of the second aspect.

The self-service terminal may be an automated teller machine (ATM), a financial services centre, a bill payment kiosk, a lottery kiosk, a postal services machine, a check-in and/or check-out terminal such as those used in the retail, hotel, car rental, gaming, healthcare, and airline industries, and the like.

These and other aspects will be apparent from the following specific description, given by way of example, with reference to the accompanying drawings.

BRIEF DESCRIPTION OF THE DRAWINGS

FIG. 1 is a simplified schematic perspective diagram of a media cassette in the form of a currency cassette according to one embodiment of the present invention;

FIG. 2 is a simplified schematic diagram of a body portion of the currency cassette of FIG. 1 shown with a lid removed;

FIG. 3 is a simplified sectional side view of the body portion of the cassette of FIG. 1 illustrating a pusher plate assembly;

FIG. 4 is a pictorial perspective view of the pusher plate assembly of the currency cassette of FIG. 1;

FIG. 6 is a pictorial cross-sectional view of the pusher plate assembly of FIG. 4 engaged with part (the loading position detent) of the currency cassette body of FIG. 2;

DETAILED DESCRIPTION

Figure 5:
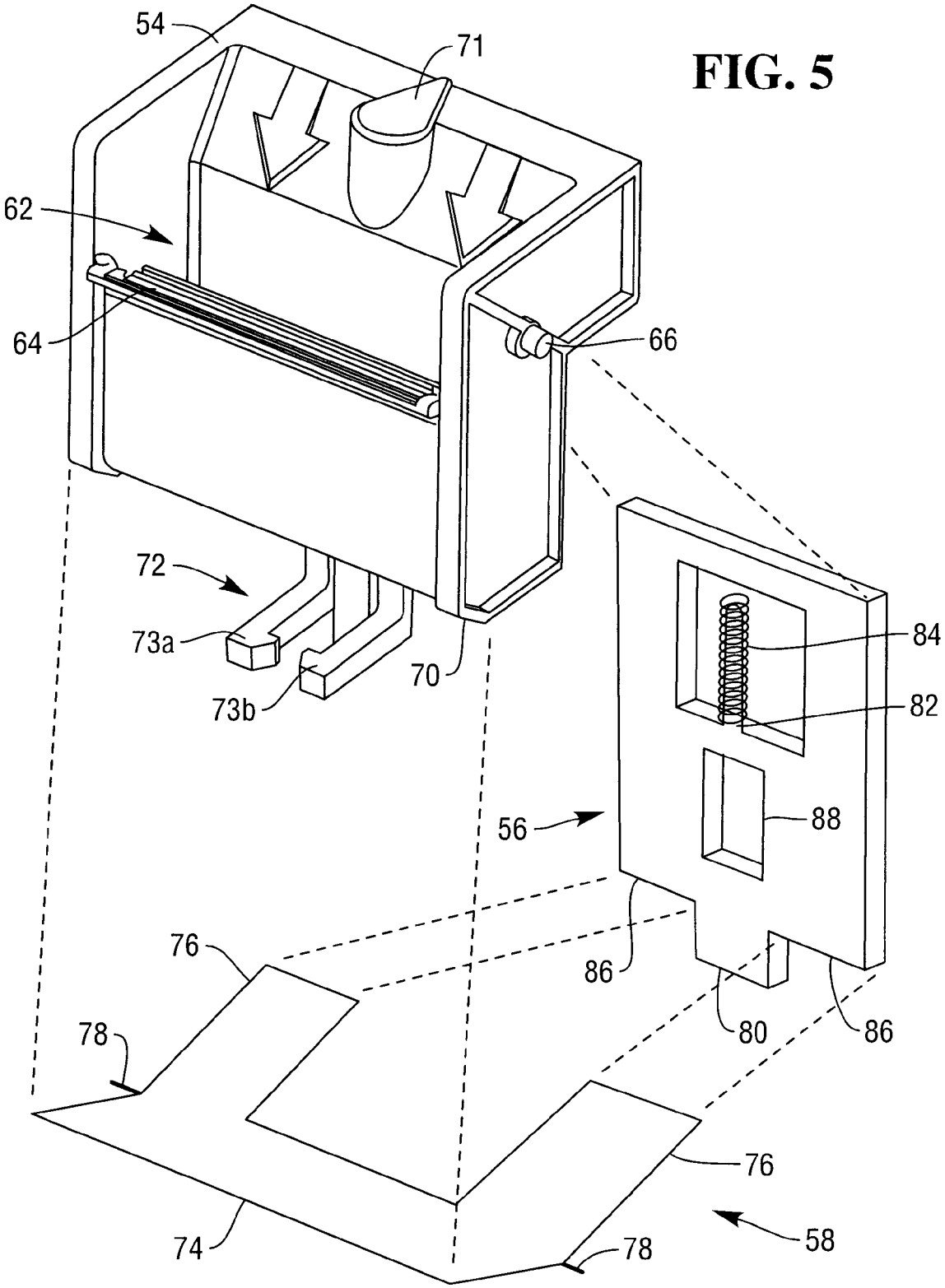
FIG. 5 is an exploded perspective view of parts (the finger recess component, the actuator, and the pawl) of the pusher plate assembly of FIG. 4.

Reference is first made to FIGS. 1 to 3, which illustrate a media cassette 10 in the form of a polycarbonate currency cassette for storing banknotes. The cassette 10 has a lid 12 secured to a body 14 by a latch 16. The body 14 has a handle 18 at a handle end 20 (a "non-picking end"), and a closed pick window (or media removal window) 22 at the opposite end 24 (a "picking end").

The picking end 24 includes a roller shutter 26 covering the pick window 22 when the currency cassette 10 is being transported. As is known in the art, when a currency cassette is inserted into a currency dispenser (not shown) in an ATM (not shown), tines 28 in the currency dispenser protrude through channels 30 in the currency cassette 10 and engage with blocks (not shown) mounted in the currency cassette 10 to lower the roller shutter 26 thereby opening the pick window 22.

The cassette 10 includes a floor 40, beneath which the abovementioned blocks (not shown) are mounted, and beneath which a ratchet rack 42 is centrally mounted. The ratchet rack 42 extends longitudinally along the cassette 10 from the non-picking end 20 to the picking end 24. A loading position detent 44 is located near to, but spaced from, the non-picking end 20 (that is, at a loading position shown by dotted arrow 45). The loading position detent 44 includes a pair of legs 46 that extend parallel to the ratchet rack 42 and that engage with a retaining block 47.

When the currency cassette 10 is not inserted into a currency dispenser (not shown), the retaining block 47 prevents the loading position detent 44 from moving towards the non-picking end 20. However, when the currency cassette 10 is inserted into a currency dispenser (not shown), the retaining block 47 is moved by the tines 28 towards the non-picking end 20. This allows the loading position detent 44 to move towards the non-picking end 20, from the loading position 45 to an extended position, shown by dotted arrow 48.

The loading position detent 44 includes an upstanding portion 49.

A pusher plate assembly 50 is mounted over the ratchet rack 42 and biased towards the picking end 24 by a coil spring (not shown). The pusher plate assembly 50 urges a stack of banknotes towards the pick window 22, so that when the pick window 22 is open, banknotes can be picked through the pick window 22 by the currency dispenser.

If too many banknotes are inserted into the currency cassette 10 (referred to as overstuffing), then once the currency cassette 10 is inserted into a currency dispenser, the loading position detent 44 is released so that it can move towards the extended position 48. The force exerted by the stack of banknotes on the pusher plate assembly 50 moves the loading position detent 44 towards the extended position 48, thereby reducing the overstuffing condition.

Reference will now also be made to FIG. 4, which is a pictorial perspective view of the pusher plate assembly 50.

The pusher plate assembly 50 includes: (i) a housing 52, (ii) a finger recess component 54 slidably mounted within the housing 52, (iii) a pawl 56 (best seen in FIG. 3) biased downwards to a low position to protrude from the housing 52, and (iv) an actuator 58 coupled to the pawl 56 and the finger recess component 54. The housing 52 defines a pair of pivot hubs 60 about which the actuator 58 rotates.

When in the low position, the pawl 56 engages with the ratchet rack 42. The ratchet rack 42 is of the type known in the art and comprises a series of spaced profiled blocks (not shown in FIG. 4), each spaced profiled block including a vertical edge on one side (the side nearest the picking end 24) and a slope on the other side (the side nearest the non-picking end 20) so that when the pawl 56 engages with the ratchet rack 42, the pawl 56 (and therefore the entire pusher plate assembly 50) can move towards the picking end 24 but not towards the non-picking (handle) end 20.

Reference will now also be made to FIGS. 5 and 6. FIG. 5 is an exploded perspective view showing the finger recess component 54, the pawl 56, and the actuator 58 in more detail. FIG. 6 is a pictorial cross-sectional view of the pusher plate assembly 50 as it is engaged with the loading position detent 44.

The finger recess component 54 defines a cut-away entrance 62 to facilitate insertion of fingers into the finger recess component 54. The finger recess component 54 includes a high friction grip 64 (comprising elastomeric material, in this embodiment rubber) overmoulded on part of the cut-away entrance 62 to reduce the possibility of an inserted finger slipping out of the finger recess component 54.

The finger recess component 54 also defines guides 66 that slide within corresponding vertical slots 68 (best seen in FIG. 4) in the housing 52 to constrain the finger recess component 54 to generally vertical movement.

The finger recess component 54 defines a profiled urging surface 70 beneath the cut-away entrance for engaging with the actuator 58. The finger recess component 54 also defines a pad area 71 on an upper surface thereof. The pad area 71 is generally centrally located on the finger recess component 54, and its operation will be described in more detail below.

A lower part of the finger recess component 54 defines an engagement projection 72 comprising a pair of fingers 73*a,b* extending towards the handle end (non-picking end) 20.

The actuator 58 comprises a leading surface 74 and a pair of flaps 76 extending from the leading surface 74. The leading surface 74 is inclined at an angle to the pair of flaps 76. A pivot stub 78 extends from each of opposing sides of the actuator 58 near the point where each flap 76 meets the leading surface 74. The pivot stubs 78 are mounted in the pivot hubs 60 to facilitate rotation of the actuator 58 relative to the pivot hubs 60.

The pawl 56 is a generally planar component slidably mounted within the housing 52. The pawl 56 defines a pawl end 80 that engages with the ratchet rack 42. The pawl 56 also defines an internal stub 82 on which a coil spring 84 is mounted. When the pawl 56 is mounted within the housing 52 (best seen in FIG. 6), the coil spring 84 pushes against a bar portion 85 of the housing 52 to urge the pawl 56 to a low position. At the low position, the pawl end 80 protrudes from a lower part of the housing 52. The pawl end 80 is shown at a high position (fully retracted) in FIG. 6 and at the low position in FIG. 3. In the absence of downward pressure applied to the finger recess component 54, the coil spring 84 urges the pawl 56 downwards to ensure that the pawl end 80 protrudes from the lower part of the housing 52.

The pair of flaps 76 engage with lower surfaces 86 of the pawl 56 so that when the leading surface 74 is pushed downwards, the actuator 58 pivots about the pivot hubs 60, and the pair of flaps 76 move upwards, thereby moving the pawl 56 upwards and compressing the coil spring 84.

The pawl 56 also defines a pawl slot 88 through which a guide 89 (best seen in FIG. 6) in the housing 52 (the "pawl guide") protrudes. This pawl guide 89 and pawl slot 88 constrain the pawl 56 to generally vertical movement.

When a replenisher places his or her finger or fingers into the finger recess component 54, the replenisher can use these fingers to depress the finger recess component 54, which causes the profiled urging surface 70 to press on the actuator leading surface 74. This causes the actuator 58 to pivot, raising the flaps 76. As the flaps 76 rise, they lift the pawl 56 from the low position to the high position (compressing the coil spring 84 against the bar portion 85). As the pawl 56 rises, the pawl end 80 moves out of engagement with the ratchet rack 42.

Figure 7:
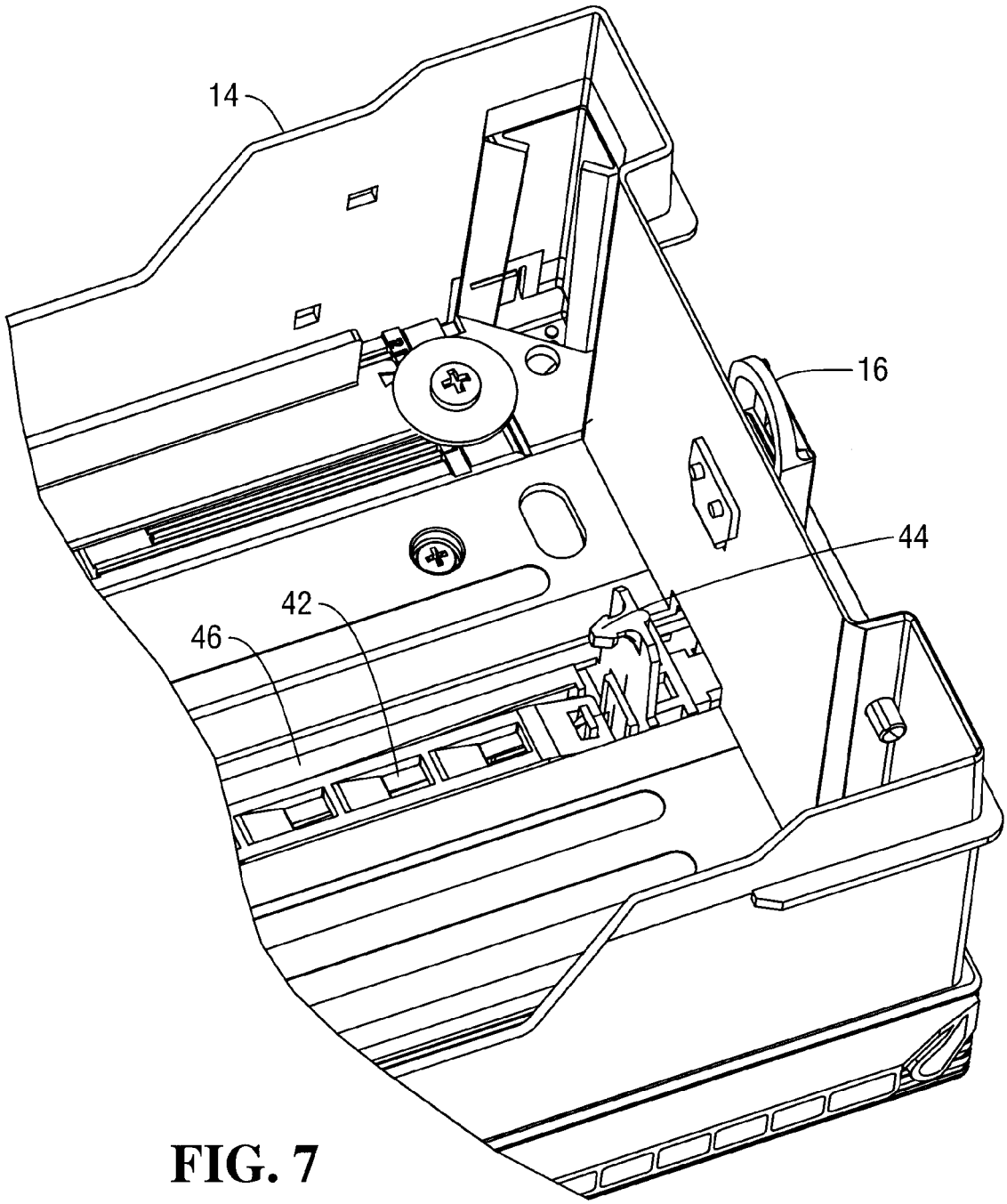
FIG. 7 is a pictorial perspective view of part of the cassette body of the currency cassette of FIG. 1.
Figure 8:
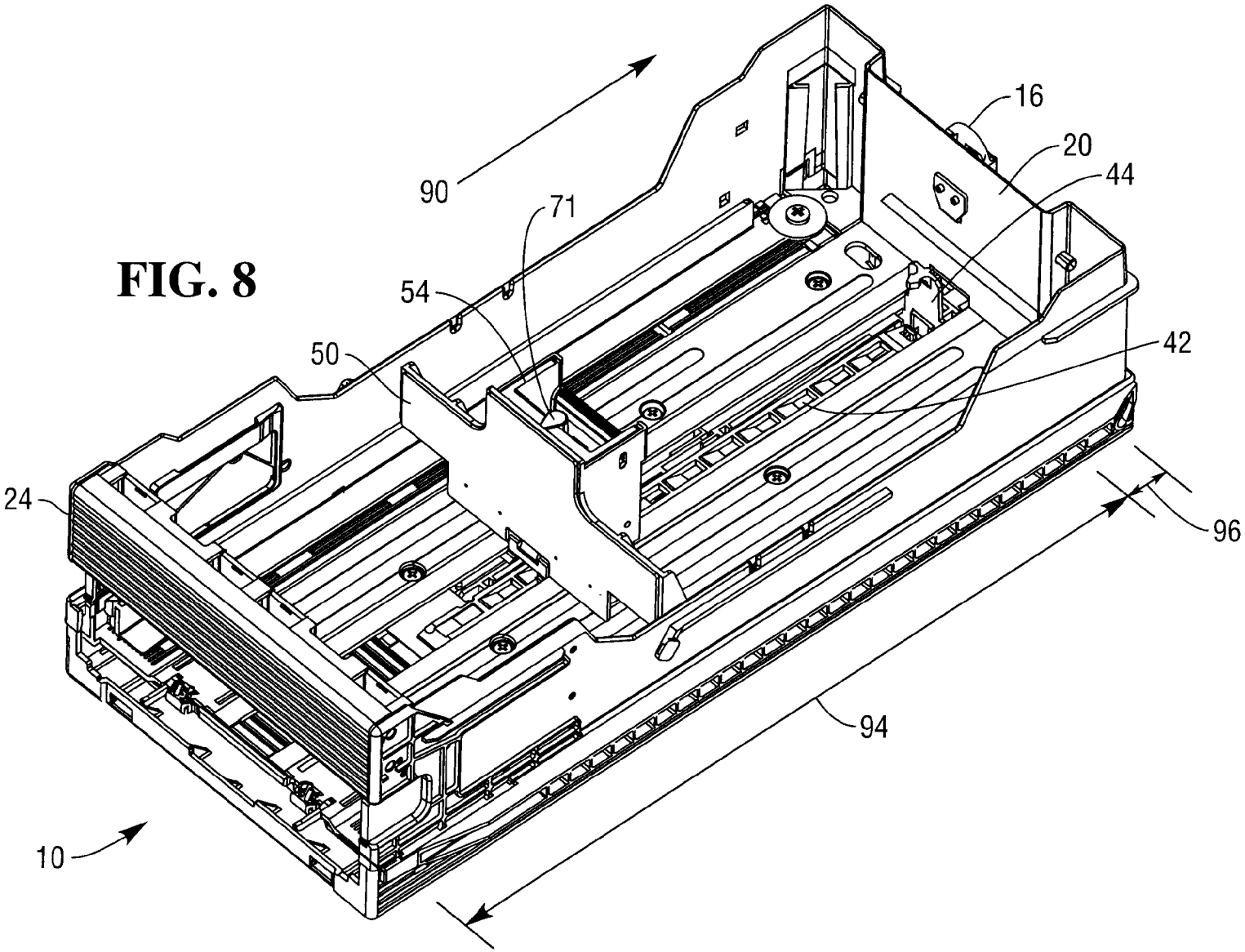
FIG. 8 is a pictorial perspective view of the entire cassette body of the currency cassette of FIG. 1.

Reference will now also be made to FIG. 7, which is a pictorial perspective view of part of the cassette body 12 of the currency cassette 10, and to FIG. 8, which is a pictorial perspective view of the entire cassette body 12 of the currency cassette 10.

When the pawl end 80 is out of engagement with the ratchet rack 42, this allows the replenisher to pull the pusher plate assembly 50 towards the handle end 20 (in the direction shown by arrow 90 in FIG. 8).

When the pusher plate assembly 50 reaches the loading position detent 44 at the loading position 45, the replenisher can reduce the downward pressure on the finger recess component 54 to allow the finger recess component 54 (and consequently the integral engagement projection 72) to rise.

When the finger recess component 54 has fully risen, the engagement projection 72 is aligned with a barbed stub 92 projecting from the upstanding portion 49 of the loading position detent 44. The engagement projection fingers 73*a,b* have complementary formations to the shape of barbed stub 92, allowing the engagement projection 72 to lock onto the upstanding portion 49. This ensures that the loading position detent 44 retains the pusher plate assembly 50 at the loading position 45 (best seen in FIG. 6).

The replenisher can then remove his/her fingers from the finger recess component 54 and use both hands to insert a horizontal stack of banknotes while the pusher plate assembly 50 is safely and securely held at the loading position.

To release the pusher plate assembly, the replenisher re-inserts his/her fingers into the finger recess component 54 and presses downwards. This moves the engagement projection 72 down and thereby disengages the engagement projection 72 from the barbed stub 92. The pusher plate assembly 50 is then urged towards the picking end 24, although the replenisher can prevent this, or reduce this, by exerting force via his/her fingers towards the non-picking end 20.

The profiled blocks defined by the ratchet rack 42 only extend along a replenishment zone 94 from near the picking end 24 to near the loading position 45. These profiled blocks prevent movement of the pusher plate assembly 50 towards the handle end 20 when the pawl 56 is in the low position. However, the ratchet rack 42 also defines an expansion zone 96 extending from the loading position 45 to near the handle end 20. This expansion zone 96 allows the pusher plate assembly 50 to move towards the handle end 20, even when the pawl 56 is in the low position. This is because the expansion zone 96 defines a channel (not shown) through which the pawl end 80 can freely move.

As described above, when the currency cassette 10 is not inserted into a currency dispenser, the retaining block 47 ensures that the loading position detent 44 is locked in position. When the currency cassette 10 is overstuffed with banknotes (that is, too many banknotes have been inserted), the locked loading position detent 44 prevents the pusher plate assembly 50 from moving towards the handle end 20, even though the pusher plate assembly 50 is in the expansion zone 96. When the currency cassette 10 is not overstuffed with banknotes then the pusher plate assembly 50 is in the replenishment zone 94, so the pawl end 80 and the ratchet rack 42 prevent the pusher plate assembly 50 from moving towards the handle end 20.

When an overstuffed currency cassette 10 is inserted into a currency dispenser (not shown), the tines 28 in the dispenser push the retaining block 47 towards the handle end 20. This unlocks the loading position detent 44 and allows it to move towards the handle end 20. The banknotes in the currency cassette 10 exert a force against the pusher plate assembly 50 because too many banknotes were inserted into the cassette 10. This force pushes the pusher plate assembly 50 and the loading position detent 44 towards the handle end 20 to the extended position 48 (best seen in FIG. 3). This can occur because the pawl end 80 moves freely through the expansion zone channel (not shown). Movement of the pusher plate assembly 50 and the loading position detent 44 to the extended position 48 creates extra space (above the expansion zone 96) for the banknotes. This extra space reduces the problem of overstuffing.

Figure 9:
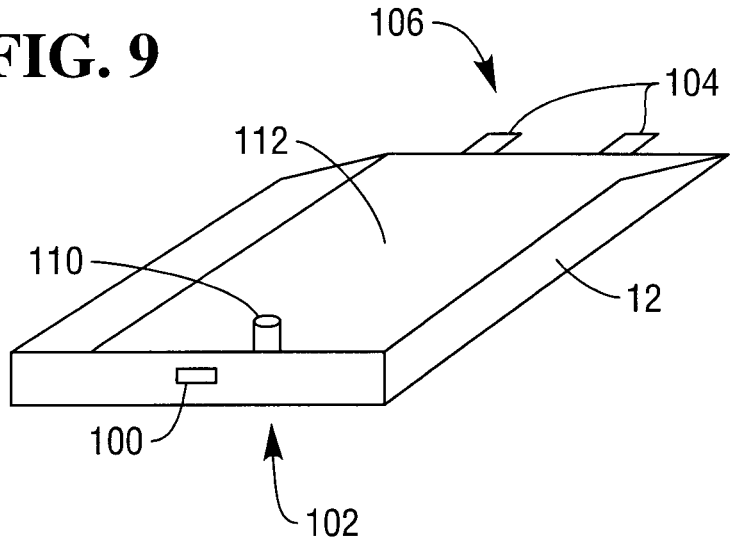
FIG. 9 is a perspective view of the removed lid of the cassette of FIG. 1, with the lid in an upside-down orientation.

Reference will now also be made to FIG. 9, which is a perspective view of the cassette lid 12 in an upside-down orientation. The cassette lid 12 includes a projection 100 at an end 102 of the lid 12 (the front end) corresponding to the handle end 20 of the cassette 10 and a pair of tabs 104 at an opposite end 106 of the lid 12 (the rear end), corresponding to the picking end 24 of the cassette 10.

The lid 12 defines a raised boss 110 that is located on an underside 112 thereof, near to the front end 102, and at a location corresponding to the loading position 45.

To couple the lid 12 to the cassette body 14, a replenisher first inserts the tabs 104 into corresponding slots (not shown) at the picking end 24 in the cassette body 14, then lowers the front end 102 over the handle end 20 of the cassette body 14 until the lid 12 is in the closed position.

Once the lid 12 is in the closed position, the latch 16 can be coupled to the cassette lid projection 100 to secure the lid 12 to the cassette body 14.

If the replenisher forgets to disengage the pusher plate assembly 50 from the loading position detent 44, then closure of the lid 12 automatically effects this. In such circumstances, when the lid 12 is lowered to the closed position, the raised boss 110 presses downwards on the pad area 71, thereby lowering the integral engagement projection 72 and disengaging the integral engagement projection 72 from the barbed stub 92 projecting from the upstanding portion 49 of the loading position detent 44. This releases the pusher plate assembly 50, and enables it to be urged towards the picking end 24 by the pusher plate coil spring (not shown).

It should now be appreciated that this embodiment provides an improved currency cassette that reduces the problem of overstuffing media items in the cassette, and that provides an improved mechanism for controlling movement of the pusher plate assembly to reduce the risk of injury to a replenisher.

Various modifications may be made to the above described embodiment within the scope of the invention, for example, in other embodiments the media items may be stamps, coupons, tickets, or the like.

In other embodiments, a different ratchet arrangement may be used. The non-engagement portion of the ratchet rack 42 may define a flat surface rather than a channel. The ratchet rack 42 may define a profiled portion extending along its entire length, but the ratchet rack 42 may only extend from the pick window 22 to near (but short of) the loading position 45. In other words, the ratchet rack 42 may be shorter than the distance between the pick window 22 and the loading position 45. This would ensure that when the pusher plate assembly 50 is located at the loading position 45, the pawl end 80 would not engage with the ratchet rack 42, leaving the pusher plate assembly 50 free to move towards the handle end 20 (when the loading position detent 44 is released on insertion into a media dispenser) if too many media items are inserted into the cassette 10.

In other embodiments the actuator may have a different shape to that described.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

What is claimed is:

1. A media cassette comprising:

a media removal window at one end of the media cassette;

a handle end at an opposite end of the cassette to the media removal window; and a pusher plate assembly including (i) a finger recess component, (ii) a pawl biased downwards to a low position, (iii) an actuator coupled to both the pawl and the finger recess component and including a pivot, the actuator being moveable on insertion of a finger into the finger recess component to raise the pawl from the low position to a high position; and (iv) an engagement projection defining one or more formations complementary to formations defined by a loading position detent located near the handle end of the media cassette.

2. A media cassette according to claim 1, wherein the media cassette further comprises:

an urging member coupled to the pusher plate and operable to bias the pusher plate assembly towards the media removal window; and a ratchet rack operable to prevent movement of the pawl towards the handle end when the pawl is in the low position and to allow movement of the pawl towards the media removal window.

3. A media cassette according to claim 2, wherein the ratchet rack includes an unprofiled portion near the handle end to allow the pusher plate assembly to move towards the handle end when the pawl is located over the unprofiled portion.

4. A media cassette according to claim 1, wherein the finger recess component is dimensioned to receive a plurality of fingers.

5. A media cassette according to claim 1, wherein the pawl is slidably mounted in the pusher plate assembly to facilitate vertical sliding.

6. A media cassette according to claim 1, wherein the engagement projection is integral with the finger recess component and extends therefrom towards the handle end of the media cassette.

7. A media cassette according to claim 6, wherein the engagement projection aligns with, but is vertically offset from, the loading position detent when the finger recess component is depressed, and aligns and engages with the loading position detent when the finger recess component is released.

8. A media cassette according to claim 1, wherein the finger recess component is slidably mounted in the pusher plate assembly and depresses one end of the actuator when the finger recess component is pushed downwards.

9. A media cassette according to claim 1, wherein the actuator comprises a bevelled cross-section and includes a rear end extending at an angle from the front end, and defines pivot shafts at edges where the front end and rear end meet.

10. A media cassette according to claim 1, wherein the media cassette further comprises a loading position detent held at a loading position by a retaining block, wherein the retaining block is displaced automatically on insertion of the media cassette into a media dispenser.

11. A media cassette according to claim 10, wherein the loading position detent includes a barbed stub extending towards the pusher plate assembly.

12. A media cassette according to claim 1, wherein the media cassette comprises a currency cassette for storing banknotes.

13. A media cassette according to claim 1, wherein the media cassette comprises an automatic pusher plate release mechanism.

14. A media cassette according to claim 13, wherein the media cassette comprises a cassette body and a removable lid, the removable lid defining a raised boss on an underside thereof, and at a location corresponding to a loading position when the lid is coupled to the cassette body.

15. A media cassette according to claim 14, wherein the finger recess component defines a pad area on an upper surface thereof and aligning with the raised boss, so that closure of the removable lid exerts downwards pressure on the finger recess component via the pad area when the pusher plate assembly is located at the loading position, thereby releasing the pusher plate assembly from the loading position.

16. A media dispenser comprising:

a pick unit including a pair of tines for engaging with a media cassette; and a media cassette according to claim 1 mounted in the pick unit.

17. A self-service terminal including the media dispenser of claim 16.

18. A media cassette comprising:

a media removal window at one end of the media cassette;

a handle end at an opposite end of the cassette to the media removal window;

a pusher plate assembly including (i) a finger recess component, (ii) a pawl biased downwards to a low position, and (iii) an actuator coupled to both the pawl and the finger recess component and including a pivot, the actuator being moveable on insertion of a finger into the finger recess component to raise the pawl from the low position to a high position; and an urging member coupled to the pusher plate and operable to bias the pusher plate assembly towards the media removal window; and a ratchet rack operable to prevent movement of the pawl towards the handle end when the pawl is in the low position and to allow movement of the pawl towards the media removal window.

19. A media cassette comprising:

a media removal window at one end of the media cassette;

a handle end at an opposite end of the cassette to the media removal window; and a pusher plate assembly including (i) a finger recess component, (ii) a pawl biased downwards to a low position, and (iii) an actuator coupled to both the pawl and the finger recess component and including a pivot, the actuator being moveable on insertion of a finger into the finger recess component to raise the pawl from the low position to a high position, wherein the actuator comprises a bevelled cross-section and includes a rear end extending at an angle from the front end, and defines pivot shafts at edges where the front end and rear end meet.

20. A media cassette comprising:

a media removal window at one end of the media cassette;

a handle end at an opposite end of the cassette to the media removal window;

a pusher plate assembly including (i) a finger recess component, (ii) a pawl biased downwards to a low position, and (iii) an actuator coupled to both the pawl and the finger recess component and including a pivot, the actuator being moveable on insertion of a finger into the finger recess component to raise the pawl from the low position to a high position; and a loading position detent held at a loading position by a retaining block, wherein the retaining block is displaced automatically on insertion of the media cassette into a media dispenser.

* * * * *